US012644618B2

(12) United States Patent
Wolowicz et al.

(10) Patent No.: US 12,644,618 B2
(45) Date of Patent: Jun. 2, 2026

(54) SYSTEM AND METHOD FOR CONTROLLING VENTILATION AIR OF A TARGET SPACE

(71) Applicant: Lennox Industries Inc., Richardson, TX (US)

(72) Inventors: Thomas John Wolowicz, Allen, TX (US); Sanjeev Hingorani, Gainesville, FL (US)

(73) Assignee: Lennox Industries Inc., Richardson, TX (US)

( * ) Notice: Subject to any disclaimer, the term of this patent is extended or adjusted under 35 U.S.C. 154(b) by 467 days.

(21) Appl. No.: 18/455,896

(22) Filed: Aug. 25, 2023

(65) Prior Publication Data

US 2025/0067455 A1 Feb. 27, 2025

(51) Int. Cl.

| | |
|---|---|
| ***F24F 11/49*** | (2018.01) |
| ***F24F 3/147*** | (2006.01) |
| ***F24F 11/48*** | (2018.01) |
| ***F24F 11/64*** | (2018.01) |
| ***F24F 11/67*** | (2018.01) |
| ***F24F 11/72*** | (2018.01) |
| ***F24F 11/89*** | (2018.01) |
| *F24F 11/46* | (2018.01) |
| *F24F 110/10* | (2018.01) |
| *F24F 110/50* | (2018.01) |

(Continued)

(52) U.S. Cl.

CPC ..... *F24F 11/49* (2018.01); *F24F 3/147* (2013.01); *F24F 11/48* (2018.01); *F24F 11/64* (2018.01); *F24F 11/67* (2018.01); *F24F 11/72* (2018.01); *F24F 11/89* (2018.01); *F24F 11/46* (2018.01); *F24F 2110/10* (2018.01); *F24F 2110/50* (2018.01); *F24F 2120/20* (2018.01); *F24F 2140/50* (2018.01); *F24F 2221/54* (2013.01)

(58) Field of Classification Search

CPC .. F24F 11/49; F24F 11/48; F24F 11/64; F24F 11/67; F24F 11/72; F24F 11/89; F24F 11/46; F24F 3/147; F24F 2110/50; F24F 2110/10; F24F 2140/50; F24F 2221/54; F24F 2120/20

USPC ..... 454/256

See application file for complete search history.

(56) References Cited

U.S. PATENT DOCUMENTS 6,973,794 B2 * 12/2005 Street ..... G05D 23/1917 62/181
8,364,318 B2 * 1/2013 Grabinger ..... F24F 11/77 454/333
9,420,725 B2 * 8/2016 Honda ..... F24F 1/0083

(Continued)

*Primary Examiner* — Steven B McAllister
*Assistant Examiner* — Dana K Tighe
(74) *Attorney, Agent, or Firm* — Baker Botts L.L.P.

(57) ABSTRACT

The disclosure provides a method of operating a (HVAC) system. The method includes measuring a concentration of a gas in the target space, and determining that the concentration exceeds a gas concentration threshold. The method includes determining that operation of the HVAC system in a ventilation mode is indicated to reduce the concentration of the gas. The method includes determining a total capacity of the HVAC system, and determining a current capacity of the HVAC system. The method includes causing the HVAC system to operate in the ventilation mode after validating that the total capacity is greater than the current capacity during operation of the HVAC system in the ventilation mode.

20 Claims, 2 Drawing Sheets

(51) Int. Cl.
*F24F 120/20* (2018.01)
*F24F 140/50* (2018.01)

(56) References Cited

U.S. PATENT DOCUMENTS

| | | | | |
|---|---|---|---|---|
| 11,009,267 | B2 * | 5/2021 | Rajan | F25B 5/02 |
| 11,867,415 | B2 * | 1/2024 | Maddox | F24F 1/0035 |
| 2017/0292767 | A1 * | 10/2017 | Douglas | F25B 13/00 |
| 2021/0164683 | A1 * | 6/2021 | Walton | F24F 11/83 |
| 2023/0011991 | A1 * | 1/2023 | Xu | F24F 11/74 |
| 2023/0160591 | A1 * | 5/2023 | Sloat | H04L 63/0823 700/276 |
| 2023/0366581 | A1 * | 11/2023 | Hingorani | F24F 11/0001 |

* cited by examiner

SYSTEM AND METHOD FOR CONTROLLING VENTILATION AIR OF A TARGET SPACE

TECHNICAL FIELD

This disclosure relates generally to heating, ventilation, and air conditioning (HVAC) systems. More particularly, this disclosure relates to a system and method for controlling ventilation air of a target space.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY

The systems and methods described in the present application provide practical applications and technical advantages that overcome the current technical problems described herein. In some embodiments, the systems and methods described herein may generally relate to an HVAC system. In some instances, HVAC system may controllably ventilate a target space when a gas concentration (e.g., volatile organic compounds, $CO_2$, CO, particulate matter, etc.) exceeds a gas concentration threshold. The HVAC system may controllably ventilate the target space by drawing in outdoor ventilation airflow to the target space while additionally exhausting a portion of return airflow as exhaust airflow. In this way, outdoor ventilation airflow is introduced into the target space to dilute the gas concentration, and a portion of the gas is removed in the exhaust airflow. However, in some instances, the thermal load needed to cool or heat the outdoor ventilation airflow to regulate the temperature of the target space within a set-point temperature may exceed the total capacity of the HVAC system. For example, the outdoor air may be sufficiently hot and/or humid such that it requires a thermal load to cool that exceeds the total capacity of the HVAC system. Conversely, the outdoor air may be sufficiently cold that it requires a thermal load to heat that exceeds the total capacity of the HVAC system. In these exemplary instances, HVAC systems may sacrifice regulating set-point temperature and/or humidity in the target space to prioritize ventilation to bring the gas concentration below the gas concentration threshold. These instances cause excess energy use and a loss of thermal comfort in the target space to achieve ventilation of the gas.

Embodiments of the present disclosure provide systems and methods that reduce energy utilization during a ventilation mode of an HVAC system while minimizing the loss of thermal comfort in the target space. In some embodiments, the provided HVAC system determines a current capacity for operating the HVAC system in a ventilation mode and compares the current capacity to a total capacity of the HVAC system. In some embodiments, if the current capacity to operate in the HVAC system in the ventilation mode is lower than the total capacity then the HVAC system proceeds to operate in the ventilation mode. Conversely, if the current capacity exceeds the total capacity, the HVAC system may operate in a modulated ventilation mode. The modulated ventilation mode may provide ventilation with minimal loss of thermal comfort in the target space, or otherwise without loss of thermal comfort in the target space.

In some embodiments, operating the HVAC system in the modulated ventilation mode may include using a blower to introduce an outdoor ventilation airflow to the target space, where a controller in the HVAC system regulates the temperature in the target space by duty cycling the blower between a first period of time where the blower is on and a second period of time where the blower is off. The controller may duty cycle the blower to maintain the temperature of the target space within a threshold of the set-point temperature. In some embodiments, operating the HVAC system in the modulated ventilation mode may include using a variable speed blower to introduce the outdoor ventilation airflow to the target space. The controller in the HVAC system may regulate the temperature in the target space by reducing a speed of the variable speed blower to lower the current capacity of the HVAC system such that the current capacity is less than or equal to the total capacity of the HVAC system. In this way, ventilation to the target space still occurs but the controller may maintain the temperature of the target space within a threshold of the set-point temperature. In some embodiments, operating the HVAC system in the modulated ventilation mode may include using a first variable damper positioned in the outdoor ventilation inlet to regulate the flow of outdoor ventilation airflow to the target space, and a second variable damper positioned in the exhaust air outlet to regulate the flow of exhaust air from the target space. A controller in the HVAC system may determine that the current capacity for operating the HVAC system in the ventilation mode is greater than the total capacity. In response, the controller may halt ventilation for a duration by closing the first variable damper and the second variable damper. After the duration, outdoor temperatures may change and the controller may determine that the current capacity for operating the HVAC system in a ventilation mode is lower than total capacity. In response, the controller may return to the normal ventilation mode by opening the first variable damper and the second variable damper. In some embodiments, operating the HVAC system in the modulated ventilation mode may include using the controller to close the first variable damper and the second variable damper to direct the return airflow through a filter positioned upstream of the blower. The return air may be recirculated through the filter to reduce the gas concentration until the total capacity exceeds the current capacity for operating the HVAC system in the ventilation mode.

The disclosed systems and methods provide several practical applications and technical advantages. First, the systems and methods provide an HVAC system configured to ventilate a gas from a target space with minimal or without loss of thermal comfort. Second, the disclosed systems and methods minimize excess energy by controlling ventilation to an available capacity of the HVAC system.

In some embodiments, the provided HVAC system comprises an air quality sensor circuit positioned in the target space, where the air quality sensor circuit is configured to sense a concentration of a gas in the target space. The HVAC system includes at least one room sensor circuit positioned in the target space, where the at least one room sensor circuit is configured to measure at least a temperature of the target space. The HVAC system includes a duct system having an outdoor ventilation inlet, a return air inlet, an exhaust air outlet, and a supply air outlet. The HVAC system includes a first heat exchanger positioned in the duct system and coupled to a refrigerant conduit, where the first heat exchanger is configured to receive a refrigerant from the refrigerant conduit. The HVAC system includes a blower positioned in the duct system, where the blower configured to move a return airflow across the first heat exchanger to transfer heat between the refrigerant and the return airflow to produce a first conditioned airflow that is communicated to the target space through the supply air outlet. The HVAC system includes at least one return air sensor circuit positioned upstream of the blower in the duct system, where the at least one return air sensor circuit configured to measure a temperature of the return airflow in the duct system. The HVAC system includes a memory operable to store a total capacity value associated with the HVAC system, wherein the total capacity value is a total thermal load (BTU/hr) that the HVAC system is configured to provide to the target space. The memory is further operable to store a gas concentration threshold for the target space. The HVAC system includes a processor operably coupled to the memory, the processor configured to receive a concentration of the gas in the target space from the air quality sensor circuit, and the processor is configured to determine that the concentration of the gas exceeds the gas concentration threshold. The processor is configured to determine that operation of the HVAC system in a ventilation mode is indicated to reduce the concentration of the gas in the target space, where the HVAC system operates in the ventilation mode by introducing outdoor ventilation airflow through the outdoor ventilation inlet and discharging exhaust airflow through the exhaust air outlet to reduce the concentration of the gas in the target space. After determining that operation of the HVAC system in the ventilation mode is indicated, the processor is configured to receive the temperature of the target space from the at least one room sensor circuit, receive the temperature of the return airflow from the at least one return air sensor circuit, and receive a flow rate of the return airflow from the blower. The processor is further configured to determine a current capacity of the HVAC system, where the current capacity is a current thermal load (BTU/hr) that the HVAC system is using to regulate the temperature of the target space, and the current capacity is determined based at least on the temperature of the target space, the temperature of the return airflow, and the flow rate of the return airflow. The processor is further configured to cause the HVAC system to operate in the ventilation mode after validating that the total capacity is greater than the current capacity during operation of the HVAC system in the ventilation mode.

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
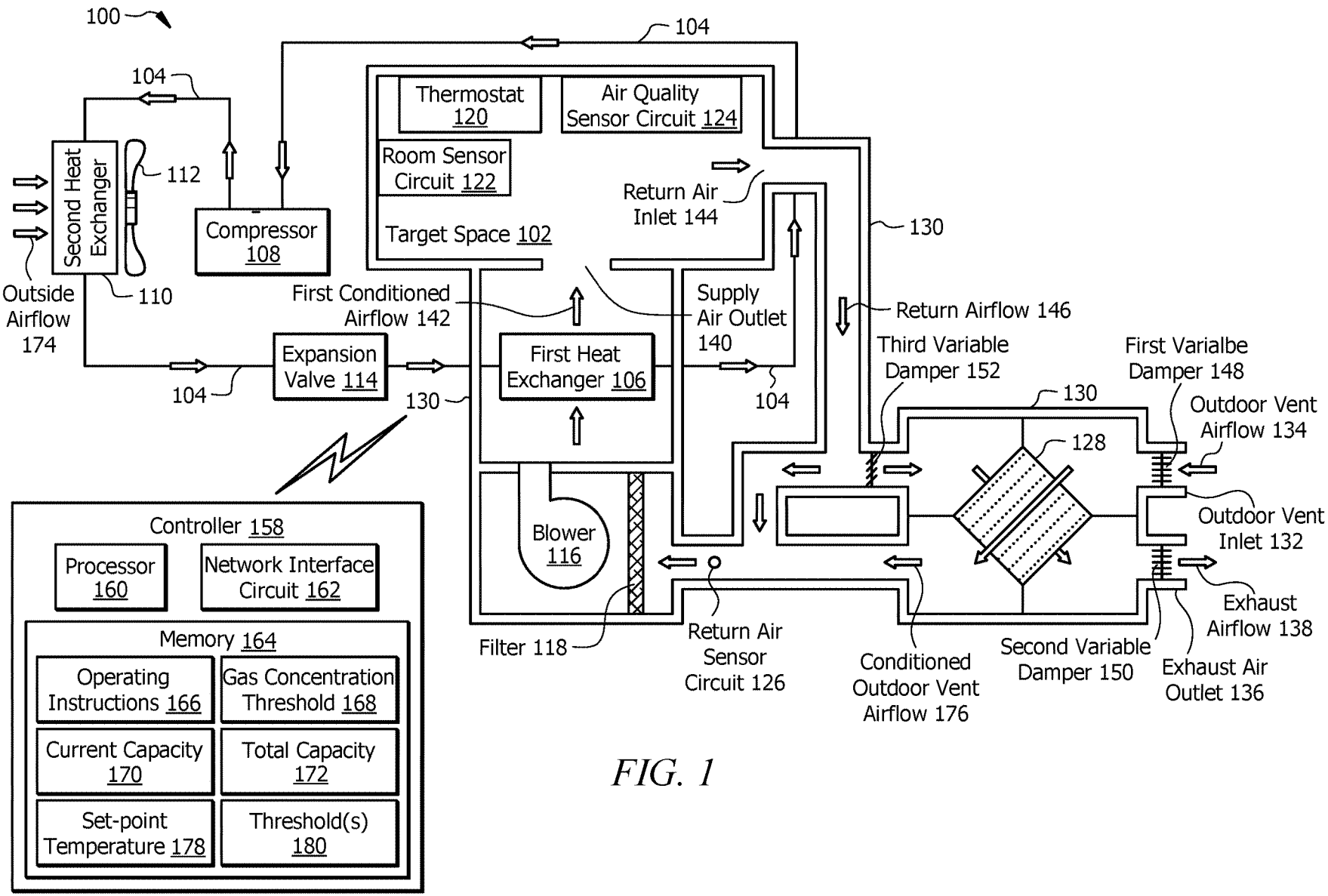
FIG. 1 is a diagram of an example HVAC system according to an embodiment of the present disclosure.
Figure 2:
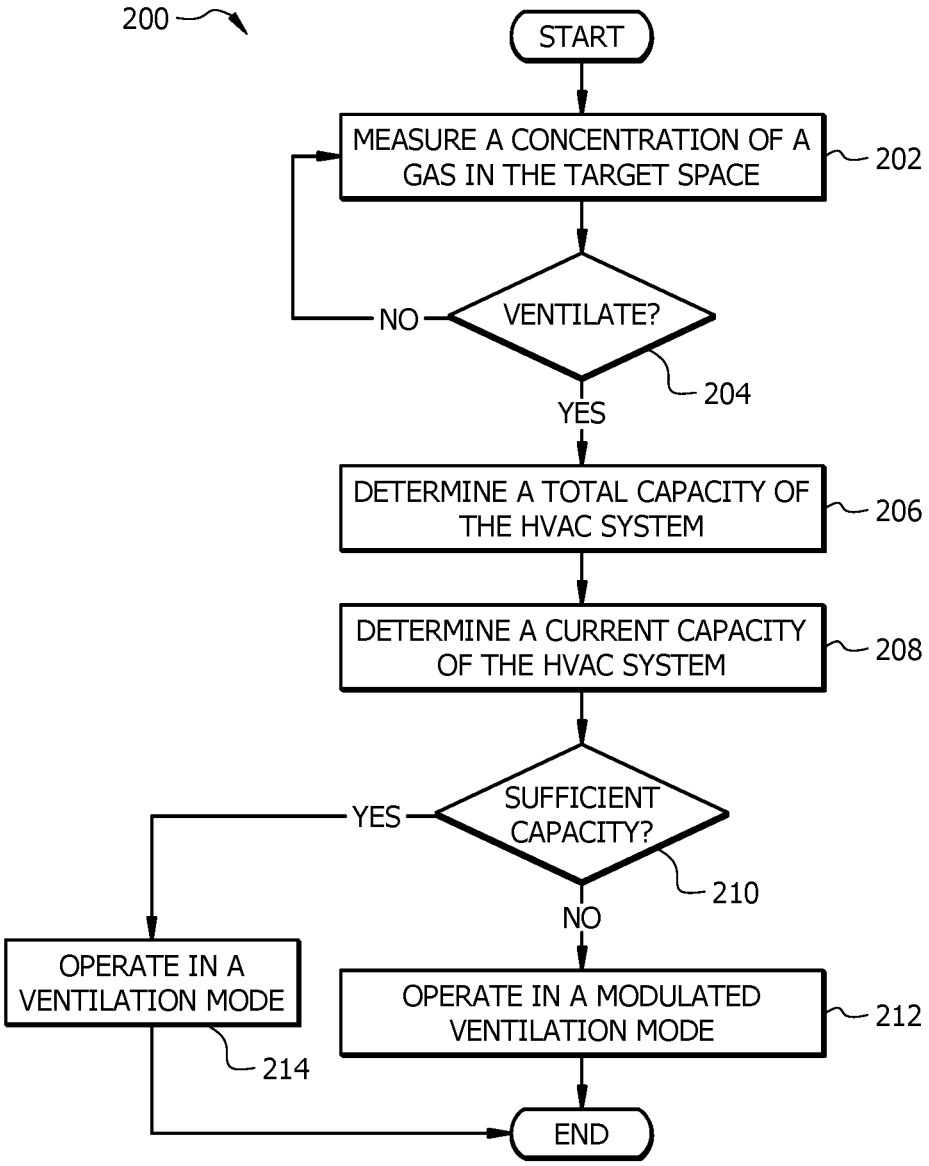
FIG. 2 is a flowchart of a method for operating the HVAC system of FIG. 1.

Embodiments of the present disclosure and its advantages are best understood by referring to FIGS. 1-2, like numerals being used for like and corresponding parts of the various drawings. As described above, in some instances, HVAC systems may controllably ventilate a target space when a gas concentration (e.g., volatile organic compounds, CO2, CO, particulate matter, etc.) exceeds a gas concentration threshold. The HVAC system may controllably ventilate the target space by drawing in outdoor ventilation airflow to the target space while additionally exhausting a portion of return airflow as exhaust airflow. In this way, outdoor ventilation airflow is introduced into the target space to dilute the gas concentration, and a portion of the gas is removed in the exhaust airflow. However, in some instances, the thermal load needed to cool or heat the outdoor ventilation airflow to regulate the temperature of the target space within a set-point temperature may exceed the total capacity of the HVAC system. In these exemplary instances, HVAC systems may sacrifice regulating set-point temperature and/or humidity in the target space to prioritize ventilation to bring the gas concentration below the gas concentration threshold. These instances cause excess energy use and a loss of thermal comfort in the target space to achieve ventilation of the gas.

Embodiments of the present disclosure provide systems and methods that reduce energy utilization during a ventilation mode of an HVAC system while minimizing the loss of thermal comfort in the target space. In some embodiments, the provided HVAC system determines a current capacity for operating the HVAC system in a ventilation mode and compares the current capacity to a total capacity of the HVAC system. If the current capacity to operate in the HVAC system in the ventilation mode is lower than the total capacity then the HVAC system proceeds to operate in the ventilation mode. Conversely, if the current capacity exceeds the total capacity, the HVAC system may operate in a modulated ventilation mode. The modulated ventilation mode may provide ventilation with minimal loss of thermal comfort in the target space, or otherwise without loss of thermal comfort in the target space.

HVAC System

FIG. 1 shows a schematic diagram of an HVAC system 100 according to an embodiment of the present disclosure. The HVAC system 100 conditions air for delivery to a target space 102. The target space 102 may be, for example, a room, a house, an office building, a warehouse, or the like. In some embodiments, the HVAC system 100 is a rooftop unit (RTU) that is positioned on the roof of a building and the conditioned air is delivered to the interior of the building. In other embodiments, portion(s) of the system may be located within the building and portion(s) outside the building. The HVAC system 100 may include one or more heating elements, not shown for convenience and clarity. The HVAC system 100 may be configured as shown in FIG. 1 or in any other suitable configuration. For example, the HVAC system 100 may include additional components or may omit one or more components shown in FIG. 1.

The HVAC system 100 includes a refrigerant conduit 104, a first heat exchanger 106, a compressor 108, a second heat exchanger 110, a fan 112, an expansion valve 114, a blower 116, a filter 118, a thermostat 120, a room sensor circuit 122, an air quality sensor circuit 124, a return air sensor circuit 126, and an air-to-air heat exchanger 128. The HVAC system 100 includes a duct system 130 having an outdoor ventilation inlet 132 configured to receive an outdoor ventilation airflow 134, an exhaust air outlet 136 configured to discharge an exhaust airflow 138, a supply air outlet 140 configured to receive a first conditioned airflow 142, a return air inlet 144 configured to receive a return airflow 146. The HVAC system 100 includes a first variable damper 148 positioned in the outdoor ventilation inlet 132, a second variable damper 150 positioned in the exhaust air outlet 136, a third variable damper 152 positioned in the return air inlet 144.

The controller 158 is generally in communication with various components in the HVAC system 100 to control their operation. For example, the controller 158 may regulate the flow rate of refrigerant in the refrigerant conduit 104 by controlling the compressor 108 and the expansion valve 114. The controller 158 also controls the flow rate of various airflows in the HVAC system by controlling the blower 116 and the various variable dampers (e.g., 148, 150, 152, 154, 156). The controller 158 is generally in communication with the thermostat 120, the room sensor circuit 122, and the return air sensor circuit 126 for sensing temperatures, pressures, and humidity of the respective space. The controller 158 is in communication with the air quality sensor circuit 124 for sensing a gas concentration, which the controller 158 is configured to compare to a gas concentration threshold 168 stored in the memory 164. The controller 158 may receive temperature and/or humidity measurements from the room sensor circuit 122 and the return air sensor circuit 126. The controller 158 may receive flow rate measurements of the first conditioned airflow 142 from the blower 116. The temperature measurements received from the room sensor circuit 122 and the return air sensor circuit 126 may be used along with the flow rate measurements of the first conditioned airflow 142 from the blower to determine a current capacity 170 that can be compared to a total capacity 172 of the HVAC system 100, as will be described in detail below.

The refrigerant conduit 104 facilitates the movement of a working fluid (e.g., a refrigerant) through a cooling cycle such that the working fluid flows as illustrated by the dashed arrows in FIG. 1. The working fluid may be any acceptable working fluid including, but not limited to hydroflurocarbons (e.g. R-410A) or any other suitable type of refrigerant.

During a cooling mode, the compressor 108, the second heat exchanger 110, and the fan 112 may form a condensing unit. The condensing unit may be an outdoor unit while other components of system 100 may be located indoors. The compressor 108 is coupled to the refrigerant conduit 104 and compresses (i.e., increases the pressure of) the working fluid. The compressor 108 may be a single-stage compressor, a variable-speed compressor, or multi-stage compressor. A variable-speed compressor is generally configured to operate at different speeds to increase the pressure of the working fluid to keep the working fluid moving along the refrigerant conduit 104. In the variable-speed compressor configuration, the speed of compressor 108 can be modified to adjust the cooling/heating capacity of the HVAC system 100. In the multi-stage compressor configuration, one or more compressors can be turned on or off to adjust the cooling capacity of the HVAC system 100.

The compressor 108 is in signal communication with the controller 158 using wired or wireless connection. The controller 158 provides commands or signals to control operation of the compressor 108 and/or receives signals from the compressor 108 corresponding to a status of the compressor 108. For example, when the compressor 108 is a variable-speed compressor, the controller 158 may provide signals to control compressor speed. When the compressor 108 operates as a multi-stage compressor, the signals may correspond to an indication of which compressors to turn on and off to adjust the compressor 108 for a given cooling capacity. The controller 158 may operate the compressor 108 in different modes corresponding to load conditions (e.g., the amount of cooling or heating required by the HVAC system 100).

The second heat exchanger 110 (e.g., condenser in a cooling mode) is configured to facilitate movement of the working fluid through the refrigerant conduit 104. The second heat exchanger 110 is generally any heat exchanger configured to provide heat transfer between the working fluid in the refrigerant conduit 104 and outside airflow 174 that passes across an outside surface of the second heat exchanger 110. The second heat exchanger 110 may include one or more circuits of coils. During the cooling mode, the second heat exchanger 110 is generally located downstream of the compressor 108 and is configured to remove heat from the working fluid. The fan 112 is configured to move the outside airflow 174 across the second heat exchanger 110. For example, the fan 112 may be configured to blow outside airflow 174 across an outside surface the second heat exchanger 110 to help cool the working fluid flowing therethrough. The compressed, cooled working fluid flows from the second heat exchanger 110 toward an expansion valve 114.

The expansion valve 114 is coupled to the refrigerant conduit 104 downstream of the second heat exchanger 110 and is configured to reduce the pressure of the working fluid. In this way, the working fluid is delivered to the first heat exchanger 106 and transfers heat with airflow exiting the blower 116 to produce a first conditioned airflow 142. The first conditioned airflow 142 is delivered through the supply air outlet 140 of the duct system 130 to the target space 102. In general, the expansion valve 114 may be a flow control valve (e.g., a thermostatic expansion valve valve) or any other suitable valve for reducing pressure from the working fluid while, optionally, providing control of the rate of flow of the working fluid. The expansion valve 114 may be in communication with the controller 158 (e.g., via wired and/or wireless communication) to receive control signals for opening and/or closing associated valves and/or provide flow measurement signals corresponding to the rate of working fluid through the refrigerant conduit 104.

The first heat exchanger 106 is positioned in the duct system 130 and coupled to the refrigerant conduit 104. During a cooling mode of operation, the first heat exchanger 106 is configured to receive the working fluid from the expansion valve 114. The first heat exchanger 106 is generally any heat exchanger configured to provide heat transfer between the working fluid in the refrigerant conduit 104 and airflow exiting the blower 116 that passes across the first heat exchanger 106. The first heat exchanger 106 may include one or more circuits of coils. During the cooling mode, the first heat exchanger 106 acts as an evaporator to transfer heat from the working fluid to the airflow exiting the blower 116. For example, during the cooling mode of operating, the airflow exiting the blower 116 has a higher temperature than the working fluid passing through the first heat exchanger 106. As the airflow exits the blower 116 and passes across the first heat exchanger 106, heat is transferred from the airflow exiting the blower 116 to the working fluid to produce the first conditioned airflow 142 that provides cooling to the target space 102 in the cooling mode. During the cooling mode of operation, the first heat exchanger 106 is fluidly connected to the compressor 108 such that working fluid generally flows from the first heat exchanger 106 to the compressor 108. The first heat exchanger 106 in the cooling mode operates as an evaporator to cool the airflow exiting the blower 116 and passing across an outer surface of the first heat exchanger 106.

Although FIG. 1 depicts the HVAC system 100 in a cooling mode, the HVAC system 100 may be operated in a heating mode. In the heating mode, a reversing valve (not shown) receives working fluid compressed by the compressor 108 and directs the working fluid from the compressor 108 to the first heat exchanger 106. During the heating mode, the first heat exchanger 106 acts as a condenser to transfer heat from the working fluid to the airflow exiting the blower 116. For example, during the heating mode of operation, the airflow exiting the blower 116 has a cooler temperature than the working fluid passing through the first heat exchanger 106. As the airflow exits the blower 116 and passes across the first heat exchanger 106, heat is transferred from the working fluid to the airflow exiting the blower 116 to produce the first conditioned airflow 142 that provides heating to the target space 102 in the heating mode. Although not shown in FIG. 1. during the heating mode, the HVAC system 100 may include an additional heating element to assist in heating the return airflow 146 and the outdoor ventilation airflow 134. The heating element may be any device for heating the airflow including, but not limited to, a gas furnace or electrical heater. During the heating mode of operation, the expansion valve 114 is coupled to the refrigerant conduit 104 downstream of the first heat exchanger 1106 and is configured to reduce pressure from the working fluid. The second heat exchanger 1110 is configured to receive the working fluid from the expansion valve 114 during the heating mode. The second heat exchanger 110 in the heating mode acts as an evaporator to remove heat from the outside airflow 174 and transfer the heat to the working fluid in the second heat exchanger 110. During the heating mode of operation, the second heat exchanger 110 is fluidly connected to the compressor 108 such that working fluid flows from the second heat exchanger 110 to the compressor 108, and the flow cycle can be repeated.

The blower 116 is positioned in the duct system 130 and is configured to move a return airflow 146 across the first heat exchanger 106 to transfer heat between the working fluid in the first heat exchanger 106 and the return airflow 146 to produce the first conditioned airflow 142. The first conditioned airflow 142 is communicated to the target space 102 through the supply air outlet 140. The airflow received by the blower 116 may comprise return airflow 146 from the target space 102, outdoor ventilation airflow 134, or some combination. The blower 116 may be a constant-speed or variable-speed circulation blower or fan. Examples of a variable-speed blower include, but are not limited to, belt-drive blowers controlled by inverters, direct-drive blowers with electronic commuted motors (ECM), or any other suitable type of blower. The blower 116 is in signal communication with the controller 158 using any suitable type of wired or wireless connection. The controller 158 is configured to provide commands and/or signals to the blower 116 to control its operation. For example, the controller 158 may be configured to send signals to the blower 116 to adjust the speed of the blower 116, for example, to increase rate of airflow if the airflow is determined to be low, based on information from one or more of sensors 122, 124, 126.

A filter 118 may be positioned in the duct system 130 upstream of the blower 116 and is configured to filter pollutants, contaminants, or gases. For example, the filter 118 may be configured to filter the return airflow 146, the outdoor ventilation airflow 134, or some combination, before the respective airflow is passed through the blower 116. Any suitable filter 118 may be used that removes pollutants, contaminants, or gases from a respective airflow including, but not limited to, high-efficiency particulate air (HEPA) filters, electrostatic filters, pleated filters, fiberglass or spun glass filters, or combinations thereof.

An air-to-air heat exchanger 128 is positioned in the duct system 130 upstream of the blower 116. The air-to-air heat exchanger 128 is configured to receive a portion of the return airflow 146 from the target space 102 and transfer heat between the return airflow 146 and the outdoor ventilation airflow 134 entering the duct system 130. The return airflow 146 exits the air-to-air heat exchanger 128 as an exhaust airflow 138 that exits the duct system 130 through the exhaust air outlet 136. The outdoor ventilation airflow 134 exits the air-to-air heat exchanger 128 as a conditioned outdoor ventilation airflow 176 that is communicated to the blower 116 via the duct system 130. The conditioned outdoor ventilation airflow 176 can be combined with the return airflow 146 in the duct system 130 prior to being communicated to the blower 116. In some embodiments, the air-to-air heat exchanger 128 is one of a heat recovery ventilation (HRV) exchanger or an energy recovery ventilation (ERV) exchanger. ERV exchangers are typically configured to transfer sensible heat as well as latent heat. For example, during the cooling mode, the ERV exchanger is configured to pre-cool and de-humidify the outdoor ventilation airflow 134. During a heating mode, the ERV exchange is configured to pre-heat and humidify the outdoor ventilation airflow 134. HRV exchangers operate in a similar manner but are typically configured to transfer sensible heat and are not configured to transfer latent heat. Suitable air-to-air heat exchangers 128 include, but are not limited to, rotary enthalpy wheels, plate heat exchangers, heat pipes, and run-around systems.

At least one room sensor circuit 122 may be positioned in the target space 102. The at least one room sensor circuit 122 is generally in signal communication with the controller 158 using any suitable type of wired or wireless connection. The room sensor circuit 122 is generally configured to measure temperature, humidity, or any other properties of the target space 102. The room sensor circuit 122 may include multiple sensors positioned anywhere throughout the target space 102 (e.g., room or building). Exemplary sensors in the one or more room sensor circuit 122 may include, but is not limited to, thermocouples, thermistors, resistance thermometers, digital thermometer integrated circuits (IC), analog thermometer integrated circuits (IC), capacitive humidity sensors, resistive humidity sensors, and thermal conductivity humidity sensors.

An air quality sensor circuit 124 may be positioned in the target space 102. The air quality sensor circuit 124 is generally in signal communication with the controller 158 using any suitable type of wired or wireless connection. The air quality sensor circuit 124 is generally configured to sense a concentration of a gas (e.g., volatile organic compounds, $CO_2$, CO, particulate matter, etc.). In some embodiments, the air quality sensor circuit 124 may include one or more sensor. For example, the air quality sensor circuit 124 may include one or more of, but is not limited to, a VOC sensor configured to detect a concentration of volatile organic compounds, a $CO_2$ sensor configured to detect a concentration of $CO_2$, a CO sensor configured to detect a concentration of CO, and a particle count sensor configured to detect a concentration of particulate matter. Non-limiting examples of sensors include, but are not limited to, photoionization detectors, flame ionization detectors, metal oxide semiconductor sensors, nondispersive infrared sensors, photoacoustic sensors, electrochemical sensors, biomimetic sensors, and aerosol particle sensors. The controller 158 may use information from the at least one room sensor circuit 122 and the air quality sensor circuit 124 for controlling the blower 116 and the compressor 108 (e.g., to increase or decrease the rate of airflow, based on information from one or more of sensors 122, 124).

A thermostat 120 may be positioned in the target space 102 (e.g., room or building). The thermostat 120 is generally in signal communication with the controller 158 using any suitable type of wired or wireless connection. The thermostat 120 may be a single-stage thermostat, a multi-stage thermostat, or any suitable type of thermostat as would be appreciated by one of ordinary skill in the art. The thermostat 120 is configured to allow a user to input a desired set-point temperature 178 for the target space 102, which can be communicated and stored in the memory 164. In some embodiments, the thermostat 120 includes a user interface and display for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100.

A first variable damper 148 is positioned in the outdoor ventilation inlet 132 of the duct system 130. The first variable damper 148 is configured to regulate an amount of outdoor ventilation airflow 134 that passes therethrough to the duct system 130, and particular an amount of outdoor ventilation airflow 134 that is received by the air-to-air heat exchanger 128. The first variable damper 148 may include damper plates that are movable between an open position that allows the outdoor ventilation airflow 134 through the damper plates and a closed position that blocks, or otherwise restricts, the passage of outdoor ventilation airflow 134 airflow through the damper plates. The damper plates may be moved manually by turning a handle outside of the HVAC system 100 or may be controlled by electric or pneumatic motors. The first variable damper 148 may be in communication with the controller 158 (e.g., via wired and/or wireless communication). The controller 158 may communicate control signals to the electric or pneumatic motor of first variable damper 148 for adjusting the position of the damper plates to control the amount of outdoor ventilation airflow 134 that passes therethrough.

A second variable damper 150 is positioned in the exhaust air outlet 136 of the duct system 130. The second variable damper 150 is configured to regulate an amount of exhaust airflow 138 that exits the duct system 130, and in particular an amount of exhaust airflow 138 that exits the air-to-air heat exchanger 128. The second variable damper 150 may include damper plates that are movable between an open position that allows the exhaust airflow 138 through the damper plates and a closed position that blocks, or otherwise restricts, the passage of exhaust airflow 138 through the damper plates. The damper plates may be moved manually by turning a handle outside of the HVAC system 100 or may be controlled by electric or pneumatic motors. The second variable damper 150 may be in communication with the controller 158 (e.g., via wired and/or wireless communication). The controller 158 may communicate control signals to the electric or pneumatic motor of second variable damper 150 for adjusting the position of the damper plates to control the amount of exhaust airflow 138 that passes therethrough.

A third variable damper 152 is positioned in the duct system 130 and is configured to receive return airflow 146 from the return air inlet 144. The third variable damper 152 may include damper plates that are movable between an open position that allows the return airflow 146 through the damper plates and a closed position that blocks, or otherwise restricts, the passage of return airflow 146 through the damper plates. In some embodiments, when the third variable damper 152 is in an open position a portion the return airflow 146 is directed to the air-to-air heat exchanger 128 and the exhaust air outlet 136. In some embodiments, when the third variable damper 152 is in a closed position the return airflow 146 is directed to the blower 116.

The controller 158 is communicatively coupled (e.g., via wired and/or wireless connection) to components in the HVAC system 100 and configured to control their operation. In some embodiments, controller 158 can be one or more controllers associated with one or more components of the HVAC system 100. The controller 158 includes a processor 160, a network interface circuit 162, and a memory 164. The processor 160 comprises one or more processors operably coupled to the memory 164. The processor 160 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 164 and controls the operation of HVAC system 100. The processor 160 may be a programmable logic device, a microcontroller, a microprocessor, or any suitable combination of the preceding. The processor 160 is communicatively coupled to and in signal communication with the memory 164. The one or more processors are configured to process data and may be implemented in hardware or software. For example, the processor 160 may be 8-bit, 16-bit, 32-bit, 64-bit or of any other suitable architecture. The processor 160 may include an arithmetic logic unit (ALU) for performing arithmetic and logic operations, processor registers that supply operands to the ALU and store the results of ALU operations, and a control unit that fetches instructions from memory 164 and executes them by directing the coordinated operations of the ALU, registers, and other components. The processor 160 may include other hardware and software that operates to process information, control the HVAC system 100, and perform any of the functions described herein. The processor 160 is not limited to a single processing device and may encompass multiple processing devices.

The memory 164 includes one or more disks, tape drives, or solid-state drives, and may be used as an over-flow data storage device, to store programs when such programs are selected for execution, and to store instructions and data that are read during program execution. The memory 164 may be volatile or non-volatile and may comprise ROM, RAM, ternary content-addressable memory (TCAM), dynamic random-access memory (DRAM), and static random-access memory (SRAM). The memory 164 is operable to store any suitable set of instructions, logic, rules, and/or code for executing the functions described in this disclosure. For example, the memory 164 may store operating instructions 166 for the various components in the system 100, a gas concentration threshold 168 of the target space 102, a current capacity 170 of the HVAC system 100, a total capacity 172 of the HVAC system, a set-point temperature 178 of the target space 102, and/or threshold(s) 180.

The network interface circuit 162 is configured to communicate data and signals with other devices. For example, the network interface circuit 162 may be configured to communicate electrical signals with the other components of the HVAC systems 100. The network interface circuit 162 may comprise ports and/or terminals for establishing signal communications between the controller 158 and other devices or components. The network interface circuit 162 may be configured to enable wired and/or wireless communications. Connections between various components of the HVAC system 100 may be wired or wireless. For example, conventional cable and contacts may be used. In some embodiments, a wireless connection is employed to provide at least some of the connections between components of the HVAC system 100. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 158 to other components of the HVAC system 100.

In some embodiments, the processor 160 is configured to receive a concentration of the gas in the target space 102 from the air quality sensor circuit 124. The processor 160 is configured to determine whether the concentration of the gas in the target space 102 exceeds the gas concentration threshold 168 stored in the memory 164. In response, the processor 160 may determine that operation of the HVAC system 100 in a ventilation mode is indicated to reduce the concentration of the gas in the target space 102. As described, the HVAC system 100 may operate in the ventilation mode by opening the first variable damper 148 to introduce outdoor ventilation airflow 134 through the outdoor ventilation inlet 132 and discharging exhaust airflow 138 through the exhaust air outlet 136 to reduce the concentration of the gas in the target space 102. After determining that operation of the HVAC system 100 in the ventilation mode is indicated, the processor 160 is configured to receive the temperature of the target space 102 from the at least one room sensor circuit 122, receive the temperature of the return airflow 146 from the at least one return air sensor circuit 126, and receive a flow rate of the first conditioned airflow 142 from the blower 116.

The processor 160 is configured to determine a current capacity 170 of the HVAC system 100, where the current capacity 170 is a current thermal load (BTU/hr) that the HVAC system 100 is using to regulate the temperature of the target space 102. The current capacity 170 may be determined based on the temperature and/or humidity of the target space 102, the temperature and/or humidity of the return airflow 146, and the flow rate of the first conditioned airflow 142. For example, the current capacity may be determined using the following:

$$\text{Current Capacity } (\text{BTU/hr}) = 4.5(\Delta h)(CFM) \qquad \text{Eqn. 1}$$

where Δh is the enthalpy difference between the target space 102 and the return airflow 146, and (CFM) is the cubic feet per minute of the first conditioned airflow 142. In some embodiments, the current capacity may be determined using the following:

$$\text{Current Capacity } (\text{BTU/hr}) = 1.1(\Delta T)(CFM) \qquad \text{Eqn. 2}$$

where ΔT is the temperature difference between the target space 102 and the return airflow 146, and (CFRM) is the cubic feet per minute of the first conditioned airflow 142. The processor 160 is further configured to cause the HVAC system 100 to operate in the ventilation mode after validating that the total capacity of the HVAC system 100 is greater than the current capacity of the HVAC system 100 during operation of the HVAC system 100 in the ventilation mode. The total capacity 172 is a maximum thermal load (BTU/hr) that the HVAC system 100 is capable of producing at a set of operating conditions. For example, the total capacity 172 may be determined using Eqns. 1-2, where the maximum flow rate of the blower 116 is used at a given flow rate of the compressor 108 and the fan 112. The total capacity 172 may be stored in the memory 164 for a range of operating conditions for the HVAC system 100.

In some embodiments, the processor 160 is configured to cause the HVAC system 100 to operate in a modulated ventilation mode after validating that the current capacity 170 is greater than the total capacity 172 of the HVAC system while operating in the ventilation mode. As described above, in some instances, the thermal load needed to cool or heat the outdoor ventilation airflow 134 to regulate the temperature of the target space within a set-point temperature 178 may exceed the total capacity 172 of the HVAC system 100. For example, the outdoor air may be sufficiently hot and/or humid such that it requires a thermal load to cool that exceeds the total capacity 172 of the HVAC system 100. Conversely, the outdoor air may be sufficiently cold that is requires a thermal load to heat that exceeds the total capacity 172 of the HVAC system 100. In these instances, the HVAC system 100 may operate in the modulated ventilation mode when the processor 160 regulates the temperature of the target space 102 within a threshold 180 of the set-point temperature 178 by duty cycling the blower 116 between a first period of time where the blower 116 is on and a second period of time when the blower 116 is off to maintain the set-point temperature 178 within the threshold 180. In some embodiments, the threshold 180 may be within 15% of the set-point temperature 178, 10%, 5%, 1%, or 0.1% of the set-point temperature 178. In this way, the modulated ventilation mode may achieve ventilation by reducing the concentration of the gas in the target space, but can maintain thermal comfort in the target space 102 by maintaining the set-point temperature 178.

In some embodiments, the blower 116 is a variable speed blower. In this example, the processor 160 is configured to cause the HVAC system 100 to operate in the modulated ventilation mode causing the variable speed blower 116 to introduce the outdoor ventilation airflow 134 to the target space 102. The processor 160 in the HVAC system 100 may regulate the temperature in the target space 102 by reducing a speed of the variable speed blower 116 to lower the current capacity 170 of the HVAC system 100 such that the total capacity 172 is greater than the current capacity 170 of the HVAC system 100. In this way, ventilation to the target space 102 still occurs but the processor 160 may maintain the temperature of the target space 102 within a threshold 180 of the set-point temperature 178.

In some embodiments, the processor 160 is configured to operate the HVAC system 100 in the modulated ventilation mode by causing the first variable damper 148 positioned in the outdoor ventilation inlet 132 to regulate the flow of outdoor ventilation airflow 134 to the target space 102, and the second variable damper 150 positioned in the exhaust air outlet 136 to regulate the flow of exhaust air from the target space 102. The processor 160 determine that the current capacity 170 for operating the HVAC system 100 in the ventilation mode is greater than the total capacity 172. In response, the processor 160 may halt ventilation for a duration by closing the first variable damper 148 and the second variable damper 150. After the duration, the processor 160 may resume the ventilation mode by opening the first variable damper 148 and the second variable damper 150 to determine whether the current capacity 170 for operating the HVAC system 100 in the ventilation mode is lower than total capacity 172 following the duration (e.g., outside temperatures may have changed during the duration). If it is determined that the current capacity 170 is lower than the total capacity 172, the processor 160 may continue to operate in the ventilation mode. If it is determined that the current capacity 170 is higher than the total capacity 172, the processor 160 may continue to operate in the modulated ventilation mode by closing the first variable damper 148 and the second variable damper 150 for another duration. In this way. the processor 160 may select ventilation times to vent the gas in the target space 102, while avoiding loss of thermal comfort.

In some embodiments, the processor 160 is configured to cause the HVAC system 100 to operate in the modulated ventilation mode by causing the first variable damper 148, the second variable damper 150, and optionally the third variable damper 152 to close in response to determining that the current capacity 170 exceeds the total capacity 172 of the HVAC system 100. In this way, the return airflow 146 is directed through the filter 118 positioned upstream of the blower 116. The return airflow 146 may be recirculated through the filter 118 to reduce the gas concentration. In some embodiments, the return airflow 146 is recirculated through the filter 118 until the total capacity 172 exceeds the current capacity 170 for operating the HVAC system 100, and in response the processor 160 causes the HVAC system 100 to operate in the ventilation mode. Recirculating the return airflow 146 through the filter 118 during times when the current capacity 170 exceeds the total capacity 172 allows for the processor 160 to reduce the concentration of the gas using the filter 118 while regulating the temperature of the target space within a threshold 180 of the set-point temperature 178.

System Operation

FIG. 2 illustrates an operational flow 200 of FIG. 1. The operational flow 200 can be logically described in two parts. The first part includes operations 202-208, which generally includes measuring a concentration of a gas in the target space 102, determining whether to ventilate the target space 102 based on the concentration of the gas, determining a total capacity 172 of the HVAC system 100, and determining a current capacity 170 of the HVAC system 100. The second part includes operations 210-214, which generally includes determining whether the current capacity 170 exceeds the total capacity 172 of the HVAC system when operating in the ventilation mode, operating the HVAC system 100 in the ventilation mode if the total capacity 172 exceeds the current capacity 170, and operating the HVAC system 100 in the modulated ventilation mode if the current capacity 170 exceeds the total capacity 172.

In operation, the operational flow 200 may begin at operation 202 where the air quality sensor circuit 124 measures a concentration of at least one gas in the target space 102. At operation 204, the processor 160 determines if ventilation is indicated and whether the HVAC system 100 should operate in a ventilation mode. For example, if the concentration of the at least one gas in the target space 102 is below the gas concentration threshold 168, then the operational flow 200 proceeds back to operation 202 where another concentration is determined. If the concentration of the at least one gas in the target space 102 exceeds the gas concentration threshold, then the operational flow 200 proceeds to operation 206. At operation 206, the operational flow 200 includes determining a total capacity 172 of the HVAC system 100, which can be determined by the processor 160, as described above. At operation 208, the operational flow 200 includes determining a current capacity of the HVAC system 100, which can be determined by the processor 160, as described above.

At operation 210, the operation flow 200 includes determining whether the current capacity 170 exceeds the total capacity 172 of the HVAC system when operating in the ventilation mode. For example, the processor 160 may validate that the total capacity 172 exceeds the current capacity 170 of the HVAC system 100 when operating in the ventilation mode. In response, operational flow may proceed to operation 214, which includes operating the HVAC system 100 in the ventilation mode. As described, operating in the ventilation mode may include introducing an outdoor ventilation airflow 134 to an outdoor ventilation inlet 132 of the duct system 130 using the blower 116, where the outdoor ventilation inlet 132 is in communication with the target space 102. The ventilation mode further includes communicating a return airflow 146 from the target space to the blower 116 via the duct system 130, and discharging exhaust airflow 138 in communication with the target space 102 through an exhaust air outlet 136 of the duct system 130 to reduce the concentration of the at least one gas in the target space 102.

If the processor 160 validates that the current capacity 170 exceeds the total capacity, the operational flow may proceed to operation 212, which includes operating the HVAC system 100 in a modulated ventilation mode. For example, the HVAC system 100 may operate in the modulated ventilation mode when the processor 160 regulates the temperature of the target space 102 within a threshold 180 of the set-point temperature 178 by duty cycling the blower 116 between a first period of time where the blower 116 is on and a second period of time when the blower 116 is off to maintain the set-point temperature 178 within the threshold 180. In some embodiments, the threshold 180 may be within 15% of the set-point temperature 178, 10%, 5%, 1%, or 0.1% of the set-point temperature 178. In this way, the modulated ventilation mode may achieve ventilation by reducing the concentration of the gas in the target space, but can maintain thermal comfort in the target space 102 by maintaining the set-point temperature 178.

In some embodiments, the blower 116 is a variable speed blower. In this example, the processor 160 is configured to cause the HVAC system 100 to operate in the modulated ventilation mode causing the variable speed blower 116 to introduce the outdoor ventilation airflow 134 to the target space 102. The processor 160 in the HVAC system 100 may regulate the temperature in the target space 102 by reducing a speed of the variable speed blower 116 to lower the current capacity 170 of the HVAC system 100 such that the total capacity 172 is greater than the current capacity 170 of the HVAC system 100. In this way, ventilation to the target space 102 still occurs but the processor 160 may maintain the temperature of the target space 102 within a threshold 180 of the set-point temperature 178.

In some embodiments, the processor 160 is configured to operate the HVAC system 100 in the modulated ventilation mode by causing the first variable damper 148 positioned in the outdoor ventilation inlet 132 to regulate the flow of outdoor ventilation airflow 134 to the target space 102, and the second variable damper 150 positioned in the exhaust air outlet 136 to regulate the flow of exhaust air from the target space 102. The processor 160 determine that the current capacity 170 for operating the HVAC system 100 in the ventilation mode is greater than the total capacity 172. In response, the processor 160 may halt ventilation for a duration by closing the first variable damper 148 and the second variable damper 150. After the duration, the processor 160 may resume the ventilation mode by opening the first variable damper 148 and the second variable damper 150 to determine whether the current capacity 170 for operating the HVAC system 100 in the ventilation mode is lower than total capacity 172 following the duration (e.g., outside temperatures may have changed during the duration). If it is determined that the current capacity 170 is lower than the total capacity 172, the processor 160 may continue to operate in the ventilation mode. If it is determined that the current capacity 170 is higher than the total capacity 172, the processor 160 may continue to operate in the modulated ventilation mode by closing the first variable damper 148 and the second variable damper 150 for another duration. In this way, the processor 160 may select ventilation times to vent the gas in the target space 102, while avoiding loss of thermal comfort.

In some embodiments, the processor 160 is configured to cause the HVAC system 100 to operate in the modulated ventilation mode by causing the first variable damper 148, the second variable damper 150, and optionally the third variable damper 152 to close in response to determining that the current capacity 170 exceeds the total capacity 172 of the HVAC system 100. In this way, the return airflow 146 is directed through the filter 118 positioned upstream of the blower 116. The return airflow 146 may be recirculated through the filter 118 to reduce the gas concentration. In some embodiments, the return airflow 146 is recirculated through the filter 118 until the total capacity 172 exceeds the current capacity 170 for operating the HVAC system 100, and in response the processor 160 causes the HVAC system 100 to operate in the ventilation mode. Recirculating the return airflow 146 through the filter 118 during times when the current capacity 170 exceeds the total capacity 172 allows for the processor 160 to reduce the concentration of the gas using the filter 118 while regulating the temperature of the target space within a threshold 180 of the set-point temperature 178.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112 (f) as it exists on the date of filing hereof unless the words "means for" or "step for" are explicitly used in the particular claim.

The invention claimed is:

1. A heating, ventilation, and air conditioning (HVAC) system configured to regulate a temperature of a target space of a building, the HVAC system comprising:

an air quality sensor circuit positioned in the target space, the air quality sensor circuit configured to sense a concentration of a gas in the target space;

at least one room sensor circuit positioned in the target space, the at least one room sensor circuit configured to measure at least a temperature of the target space;

a duct system having an outdoor ventilation inlet, a return air inlet, an exhaust air outlet, and a supply air outlet;

a first heat exchanger positioned in the duct system and coupled to a refrigerant conduit, wherein the first heat exchanger is configured to receive a refrigerant from the refrigerant conduit;

a blower positioned in the duct system, the blower configured to move a return airflow across the first heat exchanger to transfer heat between the refrigerant and the return airflow to produce a first conditioned airflow that is communicated to the target space through the supply air outlet;

at least one return air sensor circuit positioned upstream of the blower in the duct system, the at least one return air sensor circuit configured to measure a temperature of the return airflow in the duct system;

a memory operable to store a total capacity associated with the HVAC system, wherein the total capacity is a total thermal load (BTU/hr) that the HVAC system is configured to provide to the target space, the memory further operable to store a gas concentration threshold for the target space;

a processor operably coupled to the memory, the processor configured to:

receive the concentration of the gas in the target space from the air quality sensor circuit;

determine that the concentration of the gas exceeds the gas concentration threshold;

determine that operation of the HVAC system in a ventilation mode is indicated to reduce the concentration of the gas in the target space, wherein the HVAC system operates in the ventilation mode by introducing outdoor ventilation airflow through the outdoor ventilation inlet and discharging exhaust airflow through the exhaust air outlet to reduce the concentration of the gas in the target space;

after determining that operation of the HVAC system in the ventilation mode is indicated:

receive the temperature of the target space from the at least one room sensor circuit;

receive the temperature of the return airflow from the at least one return air sensor circuit;

receive a flow rate of the first conditioned airflow from the blower;

determine a current capacity of the HVAC system, wherein the current capacity is a current thermal load (BTU/hr) that the HVAC system is using to regulate the temperature of the target space, and wherein the current capacity is determined based at least on the temperature of the target space, the temperature of the return airflow, and the flow rate of the first conditioned airflow;

cause the HVAC system to operate in the ventilation mode after validating that the total capacity is greater than the current capacity during operation of the HVAC system in the ventilation mode.

2. The HVAC system of claim 1 further comprising:

an air-to-air heat exchanger positioned upstream of the blower in the duct system;

wherein the air-to-air heat exchanger is configured receive a portion of the return airflow from the target space and transfer heat between the return airflow and the outdoor ventilation airflow to produce a conditioned outdoor ventilation airflow and the exhaust airflow;

wherein the return airflow discharges from the air-to-air heat exchanger as the exhaust airflow through the exhaust air outlet; and wherein the outdoor ventilation airflow discharges from the air-to-air heat exchanger as the conditioned outdoor ventilation airflow that is communicated to the blower.

3. The HVAC system of claim 2, wherein the air-to-air heat exchanger is one of a heat recovery ventilation (HRV) exchanger or an energy recovery ventilation (ERV) exchanger.

4. The HVAC system of claim 1, wherein the processor is further configured to:

cause the HVAC system to operate in a modulated ventilation mode after validating that the current capacity is greater than the total capacity of the HVAC system;

wherein the HVAC system operates in the modulated ventilation mode when the processor causes the blower to introduce the outdoor ventilation airflow through the outdoor ventilation inlet and the processor causes the blower to discharge the exhaust airflow through the exhaust air outlet to reduce the concentration of the gas in the target space; and wherein the processor regulates the temperature of the target space within a threshold of a set-point temperature by duty cycling the blower between a first period of time where the blower is on and a second period of time where the blower is off to maintain the set-point temperature within the threshold.

5. The HVAC system of claim 1, wherein the blower is a variable speed blower, and the processor is further configured to:

cause the HVAC system to operate in a modulated ventilation mode after validating that the current capacity is greater than the total capacity of the HVAC system;

wherein the HVAC system operates in the modulated ventilation mode when the processor causes the blower to introduce the outdoor ventilation airflow through the outdoor ventilation inlet using the blower, and discharging the exhaust airflow through the exhaust air outlet to reduce the concentration of the gas in the target space; and wherein the modulated ventilation mode regulates the temperature of the target space within a threshold of a set-point temperature by reducing a speed of the variable speed blower such that the current capacity is less than or equal to the total capacity to maintain the set-point temperature within the threshold during the modulated ventilation mode.

6. The HVAC system of claim 1 further comprising:

a first variable damper positioned in the outdoor ventilation inlet;

a second variable damper positioned in the exhaust air outlet; and wherein the processor is further configured to cause the HVAC system to operate in a modulated ventilation mode after validating that the current capacity is greater than the total capacity of the HVAC system, and in response to determining that the current capacity is greater than the total capacity of the HVAC system, the processor is configured to:

close the first variable damper and close the second variable damper to halt ventilation for a duration;

determine that the total capacity is greater than the current capacity after the duration; and in response to determining that the total capacity is greater than the current capacity, resume the ventilation mode by opening the first variable damper and opening the second variable damper.

7. The HVAC system of claim 1 further comprising:

a first variable damper positioned in the outdoor ventilation inlet;

a second variable damper positioned in the exhaust air outlet;

a third variable damper positioned in the duct system, wherein when the third variable damper is in an open position the return airflow is directed to the exhaust air outlet, and when the third variable damper is in a closed position the return airflow is directed to the blower;

a filter positioned upstream of the blower;

wherein the processor is further configured to:

cause the HVAC system to operate in a modulated ventilation mode after validating that the current capacity is greater than the total capacity of the HVAC system;

wherein the HVAC system operates in the modulated ventilation mode when the processor closes the first variable damper and closes the second variable damper to direct the return airflow through the filter to reduce the concentration of the gas from the target space.

8. A method of operating a heating, ventilation, and air condition (HVAC) system configured to regulate a temperature of a target space, the method comprising:

measuring a concentration of at least one gas in the target space;

determining that the concentration of the at least one gas exceeds a gas concentration threshold;

determining that operation of the HVAC system in a ventilation mode is indicated to reduce the concentration of the at least one gas, wherein the HVAC system operates in the ventilation mode by:

introducing an outdoor ventilation airflow to an outdoor ventilation inlet of a duct system using a blower, wherein the outdoor ventilation inlet is in communication with the target space, wherein the duct system includes a return air inlet that communicates a return airflow from the target space to the blower; and discharging exhaust airflow in communication with the target space through an exhaust air outlet of the duct system using the blower to reduce the concentration of the at least one gas in the target space, and after determining that operation of the HVAC system in the ventilation mode is indicated, the method further comprises;

determining a total capacity of the HVAC system, wherein the total capacity is a total thermal load (BTU/hr) that the HVAC system is configured to provide to the target space;

determining a current capacity that the HVAC system, wherein the current capacity is a current thermal load (BTU/hr) that the HVAC system is using to regulate the temperature of the target space, wherein the current capacity is determined based at least on the temperature of the target space, a temperature of the return airflow, and a flow rate of the return airflow;

causing the HVAC system to operate in the ventilation mode after validating that the total capacity is greater than the current capacity during operation of the HVAC system in the ventilation mode.

9. The method of claim 8, wherein the return air inlet communicates a first portion of the return airflow from the target space to the blower and a second portion of the return airflow to the exhaust air outlet in the duct system, and the method further comprises:

transferring heat between the second portion of the return airflow and the outdoor ventilation airflow in an air-to-air heat exchanger positioned in the duct system to produce a conditioned outdoor ventilation airflow and the exhaust airflow;

wherein the return airflow discharges from the air-to-air heat exchanger as the exhaust airflow through the exhaust air outlet; and wherein the outdoor ventilation airflow discharges from the air-to-air heat exchanger as the conditioned outdoor ventilation airflow that is communicated to the blower.

10. The method of claim 9, wherein the air-to-air heat exchanger is selected from a heat recovery ventilation (HRV) exchanger and an energy recovery ventilation (ERV) exchanger.

11. The method of claim 8 further comprising:

causing the HVAC system to operate in a modulated ventilation mode after validating that the current capacity is greater than the total capacity of the HVAC system;

wherein the HVAC system operates in the modulated ventilation mode by introducing the outdoor ventilation airflow through the outdoor ventilation inlet using the blower, and discharging the exhaust airflow through the exhaust air outlet to reduce the concentration of the at least one gas in the target space; and wherein the modulated ventilation mode regulates the temperature of the target space within a threshold of a set-point temperature by duty cycling the blower between a first period of time where the blower is on and a second period of time where the blower is off to maintain the set-point temperature within the threshold.

12. The method of claim 8, wherein the blower is a variable speed blower and the method further comprises:

causing the HVAC system to operate in a modulated ventilation mode after validating that the current capacity is greater than the total capacity of the HVAC system;

wherein the HVAC system operates in the modulated ventilation mode by introducing the outdoor ventilation airflow through the outdoor ventilation inlet using the blower, and discharging the exhaust airflow through the exhaust air outlet to reduce the concentration of the at least one gas in the target space; and wherein the modulated ventilation mode regulates the temperature of the target space within a threshold of a set-point temperature by duty cycling the blower between a first period of time where the blower is on and a second period of time where the blower is off to maintain the set-point temperature within the threshold during the modulated ventilation mode.

13. The method of claim 8, wherein the method further comprises:

causing the HVAC system to operate in a modulated ventilation mode after validating that the current capacity is greater than the total capacity of the HVAC system;

wherein the HVAC system operates in the modulated ventilation mode by halting ventilation for a duration until the total capacity is greater than the current capacity of the HVAC system, and in response to validating that the total capacity is greater than the current capacity, the method further comprises introducing the outdoor ventilation airflow through the outdoor ventilation inlet using the blower, and discharging the exhaust airflow through the exhaust air outlet to reduce the concentration of the at least one gas in the target space.

14. The method of claim 8, wherein the method further comprises:

causing the HVAC system to operate in a modulated ventilation mode after validating that the current capacity is greater than the total capacity of the HVAC system;

wherein the HVAC system operates in the modulated ventilation mode by closing a first variable damper positioned in the outdoor ventilation inlet, closing a second variable damper positioned in the exhaust air outlet, and a third variable damper positioned in the duct system, wherein when the third variable damper is in an open position the return airflow is directed to the exhaust air outlet, and when the third variable damper is in a closed position the return airflow is directed to the blower, and wherein closing the third variable damper causes the return airflow to circulate through a filter positioned upstream of the blower to reduce the concentration of the at least one gas from the target space.

15. A controller of a heating, ventilation, and air conditioning (HVAC) system configured to regulate a temperature of a target space, the controller comprising:

a network interface circuit communicatively coupled to:

an air quality sensor positioned in the target space, the air quality sensor configured to sense a concentration of at least one gas in the target space;

at least one room sensor positioned in the target space, the at least one room sensor configured to measure at least the temperature of the target space;

a blower positioned in a duct system, the blower configured to move a return airflow in the duct system across a first heat exchanger to transfer heat between a refrigerant in the first heat exchanger and the return airflow to produce a first conditioned airflow that is communicated to the target space;

at least one return air sensor positioned upstream of the blower in the duct system, the at least one return air sensor configured to measure a temperature of the return airflow in the duct system;

a memory coupled to the network interface circuit, the memory operable to store a total capacity of the HVAC system, wherein the total capacity is a total thermal load (BTU/hr) that the HVAC system is configured to provide to the target space, the memory further operable to store a gas concentration threshold for the target space;

a processor operably coupled to the network interface circuit, the processor configured to:

receive the concentration of the at least one gas in the target space from the air quality sensor;

determine that the concentration of the at least one gas exceeds the gas concentration threshold;

determine that operation of the HVAC system in a ventilation mode is indicated to reduce the concentration of the at least one gas, wherein the HVAC system operates in the ventilation mode by:

introducing outdoor ventilation airflow to an outdoor ventilation inlet of the duct system, wherein the outdoor ventilation inlet is in communication with the target space; and discharging exhaust airflow in communication with the target space through an exhaust air outlet of the duct system to reduce the concentration of the at least one gas in the target space, and after determining that operation of the HVAC system in the ventilation mode is indicated, the processor is further configured to:

receive the temperature of the target space from the at least one room sensor;

receive the temperature of the return airflow from the at least one return air sensor;

receive a flow rate of the return airflow from the blower;

determine a current capacity that the HVAC system, wherein the current capacity is a current thermal load (BTU/hr) that the HVAC system is using to regulate the temperature of the target space, wherein the current capacity is determined based at least on the temperature of the target space, the temperature of the return air, and the flow rate of the return airflow; and cause the HVAC system to operate in the ventilation mode after validating that the total capacity is greater than the current capacity during operation of the HVAC system in the ventilation mode.

16. The controller of claim 15, wherein the processor is further configured to:

operate the blower to transfer the return airflow from the target space to a return air inlet in the duct system, wherein the duct system directs a first portion of the return airflow from the target space to the blower and a second portion of the return airflow to the exhaust air outlet in the duct system, and wherein an air-to-air heat exchanger is positioned in the duct system and configured to transfer heat between the second portion of the return airflow and the outdoor ventilation airflow to produce a conditioned outdoor ventilation airflow and the exhaust airflow;

wherein the return airflow discharges from the air-to-air heat exchanger as the exhaust airflow through the exhaust air outlet; and wherein the outdoor ventilation airflow discharges from the air-to-air heat exchanger as the conditioned outdoor ventilation airflow that is communicated to the blower.

17. The controller of claim 15, wherein the processor is further configured to:

cause the HVAC system to operate in a modulated ventilation mode after validating that the current capacity is greater than the total capacity of the HVAC system;

wherein the HVAC system operates in the modulated ventilation mode by introducing the outdoor ventilation airflow through the outdoor ventilation inlet using the blower, and discharging the exhaust airflow through the exhaust air outlet to reduce the concentration of the at least one gas in the target space; and wherein the modulated ventilation mode regulates the temperature of the target space within a threshold of a set-point temperature by duty cycling the blower between a first period of time where the blower is on and a second period of time where the blower is off to maintain the set-point temperature within the threshold.

18. The controller of claim 15, wherein the blower is a variable speed blower, and the processor is further configured to:

cause the HVAC system to operate in a modulated ventilation mode after validating that the current capacity is greater than the total capacity of the HVAC system;

wherein the HVAC system operates in the modulated ventilation mode by introducing the outdoor ventilation airflow through the outdoor ventilation inlet using the blower, and discharging the exhaust airflow through the exhaust air outlet to reduce the concentration of the at least one gas in the target space; and wherein the modulated ventilation mode regulates the temperature of the target space within a threshold of a set-point temperature by duty cycling the blower between a first period of time where the blower is on and a second period of time where the blower is off to maintain the set-point temperature within the threshold during the modulated ventilation mode.

19. The controller of claim 15, wherein the processor is further configured to:

cause the HVAC system to operate in a modulated ventilation mode after validating that the current capacity is greater than the total capacity of the HVAC system;

wherein the HVAC system operates in the modulated ventilation mode by halting ventilation for a duration until the total capacity is greater than the current capacity of the HVAC system, and in response to validating that the total capacity is greater than the current capacity the processor is configured to introduce the outdoor ventilation airflow through the outdoor ventilation inlet using the blower, and discharging the exhaust airflow through the exhaust air outlet to reduce the concentration of the at least one gas in the target space.

20. The controller of claim 15, wherein a filter is positioned upstream of the blower in the duct system and the network interface circuit is communicatively coupled to:

a first variable damper positioned in the outdoor ventilation inlet;

a second variable damper positioned in the exhaust air outlet;

a third variable damper positioned in the duct system, wherein when the third variable damper is in an open position the return airflow is directed to the exhaust air outlet, and when the third variable damper is in a closed position the return airflow is directed to the blower; and wherein the processor is further configured to:

cause the HVAC system to operate in a modulated ventilation mode after validating that the current capacity is greater than the total capacity of the HVAC system; and wherein the HVAC system operates in the modulated ventilation mode by closing the first variable damper, closing the second variable damper, and opening the third variable damper such that the return airflow circulates through the filter to reduce the concentration of the at least one gas from the target space.

* * * * *